United States Patent [19]

Holbert

[11] 4,456,080

[45] Jun. 26, 1984

[54] STABILIZER METHOD AND APPARATUS FOR EARTH-BORING OPERATIONS

[76] Inventor: Don R. Holbert, 6637 W. Hinsdale Ave., Littleton, Colo. 80123

[21] Appl. No.: 415,895

[22] Filed: Sep. 8, 1982

Related U.S. Application Data

[63] Continuation-in-part of Ser. No. 188,679, Sep. 19, 1980, abandoned.

[51] Int. Cl.[3] ..... E21B 17/10; E21B 17/20; E21B 17/22

[52] U.S. Cl. ..... 175/61; 175/323; 175/325; 308/4 A

[58] Field of Search ..... 175/61, 325, 323, 74, 175/320; 308/4 A

[56] References Cited

U.S. PATENT DOCUMENTS

| | | | |
|---|---|---|---|
| 496,316 | 4/1893 | Mack | 175/315 X |
| 1,971,480 | 8/1934 | Earley | 175/325 X |
| 2,589,534 | 3/1952 | Buddolph | 175/325 |
| 2,669,429 | 2/1954 | Zublin | 175/74 |
| 2,669,430 | 2/1954 | Zublin | 175/74 |
| 2,687,282 | 8/1954 | Sanders | 175/320 X |
| 2,829,864 | 4/1958 | Knapp | 175/325 |
| 3,156,310 | 11/1964 | Frisby | 175/76 |
| 3,398,804 | 8/1968 | Holbert | 175/61 |
| 3,419,094 | 12/1968 | Bobo | 175/325 |
| 3,916,998 | 11/1975 | Bass et al. | 166/301 |
| 3,945,446 | 3/1976 | Ostertag et al. | 175/325 X |
| 4,067,404 | 1/1978 | Crase | 175/75 |
| 4,245,709 | 1/1981 | Manuel | 175/325 |
| 4,273,201 | 6/1981 | Garrett | 175/325 X |

*Primary Examiner*—Stephen J. Novosad
*Attorney, Agent, or Firm*—John E. Reilly

[57] ABSTRACT

A method and apparatus for drilling straight bores into the earth is made up of a series of articulated joints which are interpositioned between a drill string and drill bit with an enlarged stabilizer member positioned between each pair of joints and the initial or lowermost section between the drill bit and first joint cooperating with the stabilizer members in such a way as to cause the entire assembly to drill on a straight line or course. In one modified form of invention, a stabilizer member is fixed for rotation behind the drill bit to straighten the drilling course, and may be employed alone or in combination with additional stabilizers and joints in the drill string.

21 Claims, 10 Drawing Figures

STABILIZER METHOD AND APPARATUS FOR EARTH-BORING OPERATIONS

This application is a continuation-in-part of my copending application, Ser. No. 188,679, filed Sept. 19, 1980 for STABILIZER METHOD AND APPARATUS FOR EARTH-BORING OPERATIONS, now abandoned.

This invention relates to stabilization assemblies and methods of utilizing same in straightening earth bores of significant curvature.

BACKGROUND AND FIELD OF THE INVENTION

In earth-boring operations, it is often necessary to straighten out the bore where the upper portion of the bore has sections with from moderate up to extreme curvature. In the past, if it were necessary to straighten out a well course below curved sections, the devices used had to be reamed through the curved sections. Often, the time required to ream was equivalent to the original drilling time for the section. This was expensive and sometimes resulted in sticking the drill string. Consequent expensive fishing jobs were required to free it. It is known that the predominant factors affecting stabilization or straightening of an earth bore are the proper articulation and geometric configuration of the stabilization assembly while maintaining an adequate or balanced force on the drill bit, since the curvature of the bore is determined primarily by the tilt of the bit within the bore.

It has been determined previously that in directional drilling operations the radius of curvature of the bore or drainhole to be drilled is related to the geometric configuration of the drilling assembly by the formula $RC=L^2/2a$ where RC is the radius of curvature of the curved bore section, L is the distance between the pivotal axis of the lowermost articulated joint and tip of the bit or reamer and a is the distance between the center line of the curved bore section and the center line of the universal joint. For instance, essentially the same relationship was recognized and discussed in my prior U.S. Letters Pat. No. 3,398,804 and was employed in connection with directional drilling operations in the selection of the universal joint and reamer in establishing a predetermined radius of curvature. I have discovered that a similar principle is applicable to stabilization or straightening of curved bores where the distance "a" defines the difference between the hole radius and stabilizer radius and "L" defines the distance between the tip of the drill bit and the trailing end of the stabilizer in contact with the wall of the hole. From this formula, it can be readily appreciated that the radius of curvature RC can approach infinity and the curvature approximate a straight line if the distance "a" is reduced to a very small value or "L" increased, or a combination of both.

In the application of this principle to stabilization assemblies, it is important that the stabilizer members be so positioned and dimensioned in relation to the drill bit as not to cut into or ream the wall of the hole. This minimizes adverse steering and the amount of torque required in drilling. To do this, it is important to reduce the "change angle" forces on the stabilizer assembly to a minimum, particularly on that stabilizer nearest to the drill bit. It is also important to reduce the effects of deflection on the drill collar between the drill bit and stabilization assembly resulting from the curvature of the bore already drilled by making that member as "stiff" (i.e. large in diameter) as possible. Moreover, the distance L can be varied by shifting the contact area between the external surface of the stabilizer and the curved wall of the bore, since the effective distance L from the tip of the bit will extend to the trailing end of the first contact area of the stabilizer.

Representative patents of interest showing different types of stabilizer arrangements are U.S. Letters Pat. Nos. 496,316 to Mack; 1,971,480 to Earley; 2,669,429 and 2,669,430 to Zublin; 2,687,282 to Sanders; 3,156,310 to Frisby and 4,067,404 to Crase.

SUMMARY OF THE INVENTION

It is an object of the present invention to provide for a novel and improved stabilization assembly adapted for interpositioning between a drill bit and drill string for use in earth-boring operations.

Another object of the present invention is to provide for a new stabilization assembly which is adaptable for use in straightening out a hole at some depth from the surface after the hole has undergone some deflection away from its original course and which is further capable of use in maintaining a straight hole section and avoiding further undesirable deflection in earth-boring operations.

It is a further object of the present invention to provide a stabilization assembly requiring a minimum number of parts which can be readily inserted between a drill bit and drill string to establish a predetermined direction of drilling and specifically to straighten out curved hole sections while reducing the effects of change angle forces and formation moments on the drill string and bit.

It is an additional object of the present invention to provide for a stabilization assembly which is readily conformable for use under various conditions and with different types of drill bit assemblies to straighten out curved hole sections in subsurface formations without the necessity of redrilling or reaming the hole, and wherein the assembly is so constructed and arranged as to tend to maintain the drill along a straight course.

In accordance with the present invention, a stabilizer assembly has been devised which is specifically adapted for use in combination with a drill pipe and drill bit for straightening earth bores and is broadly comprised of one or more universal or articulated joints, each disposed in leading relation to a stabilizer member wherein the latter has a diameter substantially corresponding to that of the bore. In addition, the first joint is separated from the drill bit by a straight section, such as, a drill collar which is dimensioned to cooperate with the first joint and stabilizer in maintaining a straight hole or bore; and, in a modified form of invention, a stabilizer is positioned on the straight section specifically for use in drainhole applications where the length of the area in contact with the wall of the bore is limited. In the different forms of invention herein set forth, in progressing away from the first joint and stabilizer member, an alternating succession of universal joints and stabilizer members can be employed, the number depending upon the extent and degree of curvature of the curved hole section, each stabilizer member preferably having a lesser diameter than the first one or two stabilizer members so as to reduce the change angle forces which are permitted to act on the respective stabilizer members in proceeding away from the members above the bit. In order to achieve optimum stabilization, or in other words to cause the drill bit to proceed in a straight line, the straight section behind the drill bit is constructed such that the distance from the tip of the bit to the contact area of the first stabilizer member is increased to the greatest possible length while the difference between the bit gauge and stabilizer gauge approaches zero. In this way, in accordance with the formula $RC=L^2/2a$ the radius of curvature drilled by the stabilizer assembly is increased to its maximum value, or approaches infinity, so that the well course of the hole section drilled is substantially along a straight line. Furthermore, the next successive stabilizer sections added will prevent change angle forces exerted on the stabilizer members from influencing the first stabilizer section and thereby avoid any reaming into the wall of the hole. In this way, the main operative force on the first stabilizer section and bit is that of the moment arm exerted on the bit by the formation as a reaction to the weight applied to the bit. The moment arm is defined by the distance to the first stabilizer member and determines how much side force will be applied to the first stabilizer from the reactive formation moment. Accordingly, enlarged stabilizer members of substantial length will reduce the side load force on the stabilizer to an amount insufficient to cause reaming of the formation. For this reason, the stabilizer members may be defined by blades arranged in equally spaced circumferential relation around a sleeve or sub and separated by grooves of relatively narrow width, or in the alternative may be defined by smooth-surfaced rings which are virtually incapable of cutting or reaming into the sidewall of the formation. Furthermore, any deflection exerted on the drill collar of the formation moment may be minimized by making the drill collar large in outside diameter so as to lend substantial stiffness to the collar and reduce any possible deflection to minimum values. Change angle forces which act on the second stabilizer section are further limited by stepping down or reducing the gauge of the stabilizers for the third, fourth or additional stabilizers utilized.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
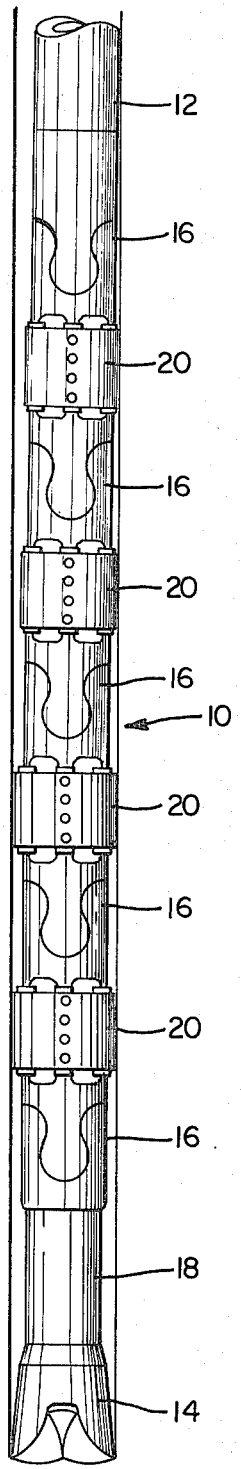
FIG. 1 is an elevational view of a preferred form of stabilizer assembly affixed to the lower end of a drill string.

Referring in detail to the drawings, there is illustrated in FIGS. 1 to 4 a preferred form of stabilizer assembly 10 interpositioned between a conventional type of drill string, the lower end of which is designated at 12, and a standard drill bit 14. The stabilizer assembly 10 is made up of a plurality of universal or articulated joints 16 with the lowermost joint 16 secured to the drill bit 14 by a drill collar 18, and a series of stabilizer members 20 are positioned intermediately between each pair of joints 16 but with the uppermost joint 16 connected directly into the lower end of the drill string 12. In addition, the drill collar may employ a stabilizer blade or ring as hereinafter described with reference to the modified form of invention shown in FIGS. 8 to 10. The universal joints 16, also customarily referred to as a flexible drill string, are preferably formed with the stabilizers constructed as a unitary part of the joints. Thus, in the preferred form each joint is provided with intermediate longitudinally extending flat surface portions as indicated at 22 which are joined by rounded off corners 23 to facilitate disposition of an outer tubular member 24 which is secured by fasteners 25 to the corners 23 in forming each stabilizer member 20. Member 24 is provided with thin-walled axial projections at closely spaced circumferential intervals around the top and bottom edges in order to minimize any tendency of the stabilizer to become jammed. In assembled relation, interconnection of the tubular member to the intermediate or rigid section of each joint leaves spaces 26 between the corners 23 for the flow of fluid therebetween as the stabilizer assembly advances downwardly through the bore. In addition, the lowermost joint 16 is provided with a pin 28 or tapered threaded portion for interconnection into the drill collar 18 in a conventional fashion, and the drill collar 18 interconnected in a well-known manner to the drill bit 14.

There is shown in FIG. 1 a series of four stabilizer sections, each stabilizer section comprised of a universal joint followed by a stabilizer ring, the diameter of the stabilizer ring or tube 24 being substantially equal to that of the bit or hole to be drilled, at least for the lowermost pair of rings nearest to the drill bit. As illustrated in FIG. 1, preferably the diameter of the next successive stabilizer members 20 is stepped down or reduced to a size slightly smaller than that of the two lowermost stabilizer members so as to minimize the effects of change angle forces on the stabilizer members, but still permit the assembly to gradually lay conformably to the low side of the hole. The universal joints 16 serve the purpose of permitting the stabilizer assembly to pass through hole sections with high curvature while preventing the stabilizing members 20 from acting as a fulcrum to apply side pressure to the bit. The first set of stabilizer members acts to keep the bit and drill collar centered in the hole while the second stabilizer prevents the development of significant reaming side forces from affecting the first stabilizer member. The remaining joints 16 and stabilizers 20 if employed, establish controlled and minimal side forces until the drill string can advance into contact with the low side of the hole.

Important to a consideration of the present invention is a recognition of the proper configuration and support necessary during drilling to maintain a stable geometry when necessary to straighten a curved hole section. Essentially, curvature is determined by the tilt of the bit within the hole. As earlier described, it will be shown that the radius of curvature in the hole is related to the geometric tilt or cocking of the drilling assembly by the formula $RC=L^2/2a$. If the distance "a" can be reduced to a small value or "L" increased to a large value, the radius of curvature will be large. If the first two stabilizer members are equal in diameter to the bit and do not cut in to the wall of the hole, the $2a$ dimension would be the difference between the gauge the hole actually drills and the stabilizer diameter while the dimension "L" is the distance from the tip of the bit to the trailing end of the area of contact of the first stabilizer member with the wall of the hole. Further, in actual practice, a drill bit will tend to drill a hole slightly larger than its diameter and since this oversize or "overbreak" is usually small in value, relatively short drill collars between the bit 14 and stabilizer assembly 10 could maintain curvature less than 0.1° per 100'. In order to maintain this configuration, it is important to prevent the stabilizer members from digging into the wall of the hole. Thus, the second stabilizer member assists by preventing any change angle forces from pushing on the first stabilizer from the back. The main operative force is that of the moment exerted by the formation as a reaction to the weight applied to the bit and is determined principally by the distance or moment arm established between the tip of the bit and the first stabilizer member. Thus, a stabilizer ring of substantial length in relation to the spacing between the joints 16 helps to reduce the stabilizer side load force to a pressure insufficient to ream the formation behind the bit and which is further aided by the utilization of rings 24 which are virtually incapable of cutting or reaming into the side wall. Any tendency of the formation moment to deflect the drill collar can be overcome in the construction of the drill collar itself and by making it sufficiently large or of sufficient strength or stiffness to reduce any deflection to minimal values.

Figure 5:
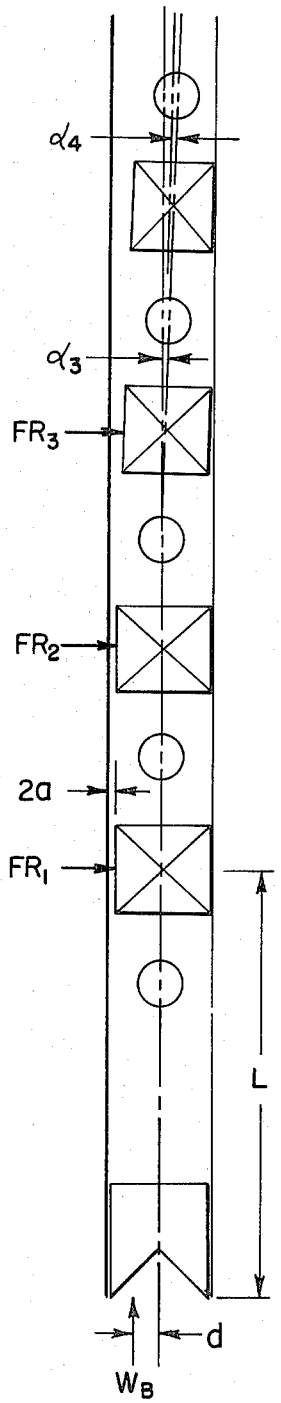
FIG. 5 is a somewhat schematic view illustrating the forces imposed on the stabilizer assembly of FIG. 1 in forming a straight bore as a continuation of a curved bore section.

A consideration of the force diagram shown in FIG. 5 will lead to a better appreciation of the ability of the stabilizer assembly of the present invention to orient itself in a straight line, or in other words, to take off on a straight course even after passing through a curved bore section. As represented in the drawing, FIG. 5, $W_B$ is the weight applied to the bit. If the formation were neutral, the bit weight would be opposed by a force axially aligned with the bit. More likely, however, is that there would be an opposing force displaced a distance "d" creating a moment $M_B$ attempting turn the bit. This moment $M_B$ causes a force $FR_1$ on the first stabilizer tending to push it to one side. This force $FR_1=M_B/L$. If the first stabilizer is unable to ream either by design or because force $FR_1$ is insufficient to cut into the sidewall, the radius of curvature of the hole, RC, will be determined by the square of the distance from the tip of the bit to the trailing point of the area of contact with the hole wall of the first stabilizer 20 as indicated, and the difference between the drilled diameter of the hole and the diameter of the stabilizer, $2a$. The reaming force $FR_1$ may be increased by the product of the sine of the change angle behind the stabilizer member times the drilling weight. In the force diagram shown in FIG. 5, the first two stabilizers have the same diameter so that this force is very close to zero. However, this is not true for the next stabilizer which has a change angle $\alpha_3$ behind it and consequently a force $FR_2 = \text{sine } \alpha_3 \times W_B$. However, this stabilizer is effectively insulated from the usually more significant reactive force from the bit. Further, only the first stabilizer steers the drilling assembly. The stabilizer assembly is designed such that the straight section running from the tip of the bit to the first stabilizer is of the maximum allowable length which will permit it to pass through the curved hole section into contact with the bottom of the hole so that the radius of curvature will be as great as possible; and assuming $2a$ is approaching zero, the curvature would then approach that of a straight line.

The force diagram as described assumes that frictional forces are negligible as well as the effect of a formation moment in causing a deflection in the drill collar since such deflection can be controlled by the design of the drill collar as described.

DETAILED DESCRIPTION OF THE MODIFIED FORM OF THE INVENTION

Figure 6:
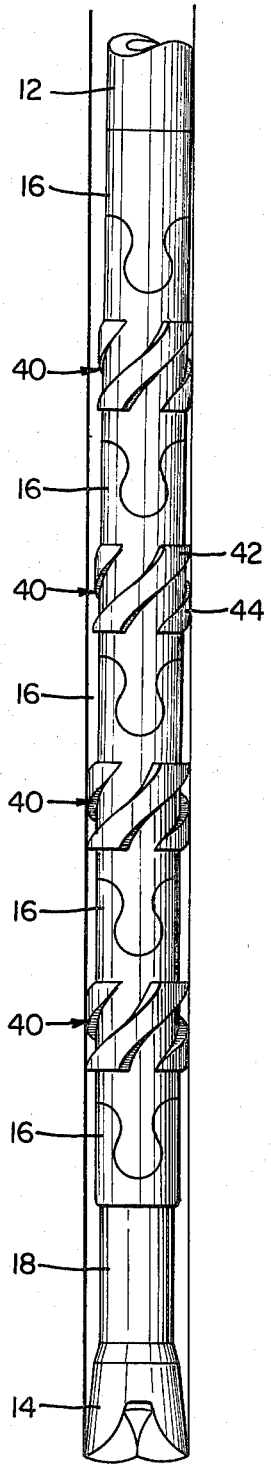
FIG. 6 is an elevational view of a modified form of stabilizer assembly.
Figure 2:
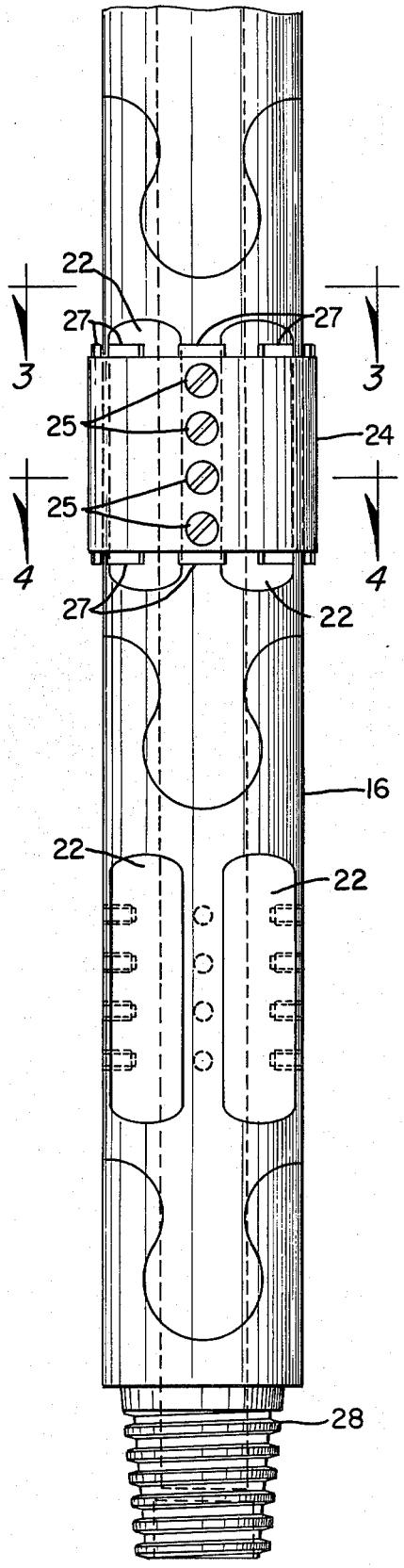
FIG. 2 is an enlarged view in detail of a portion of the preferred form of stabilizer assembly shown in FIG. 1.
Figure 3:
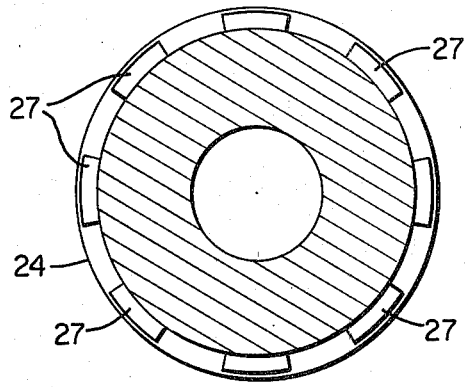
FIG. 3 is a cross-sectional view taken about lines 3—3 of FIG. 2.
Figure 4:
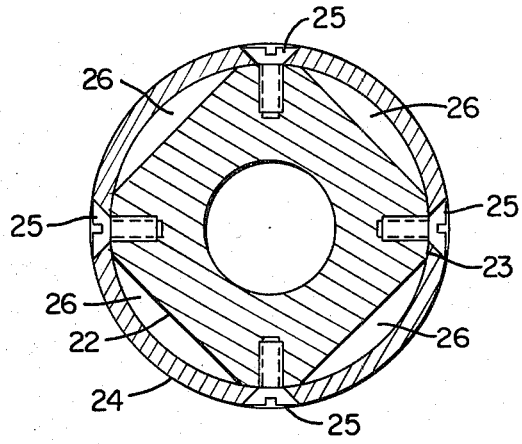
FIG. 4 is a cross-sectional view taken about lines 4—4 of FIG. 2.

A modified form of stabilizer assembly is illustrated in FIG. 6 in which like parts to that of the preferred form are correspondingly enumerated and is seen to comprise once again a drill string 12 from which are suspended a series of universal joints 16, the lowermost joint 16 terminating in a drill collar 18 which is threaded into a drill bit 14. In the modified form, the rigid section of each joint 16 is generally cylindrical throughout and has a series of spiral stabilizer blades 40 in the form of ribs which are affixed to the external surface at the intermediate portion of the cylindrical section 42 on each universal joint. The overall length of each stabilizer blade member 40 corresponds to that of a ring 24 in the preferred form, and the blades or ribs 40 are arranged at equally spaced circumferential intervals and extend in helical fashion such that the upper end of each blade will overlap the lower end of each next successive blade 40. Moreover, each blade is given a slight downward taper as indicated at 44 to minimize any tendency of the blades 40 to cut or ream into the formation as drilling progresses from the curved section into the straight section as previously described. The overall diameter of the stabilizer members 40 again corresponds to that of the hole to be drilled so as to achieve maximum stabilization in combination with the maximum permissible length from the tip of the drill bit to the first stabilizer member.

Figure 7:
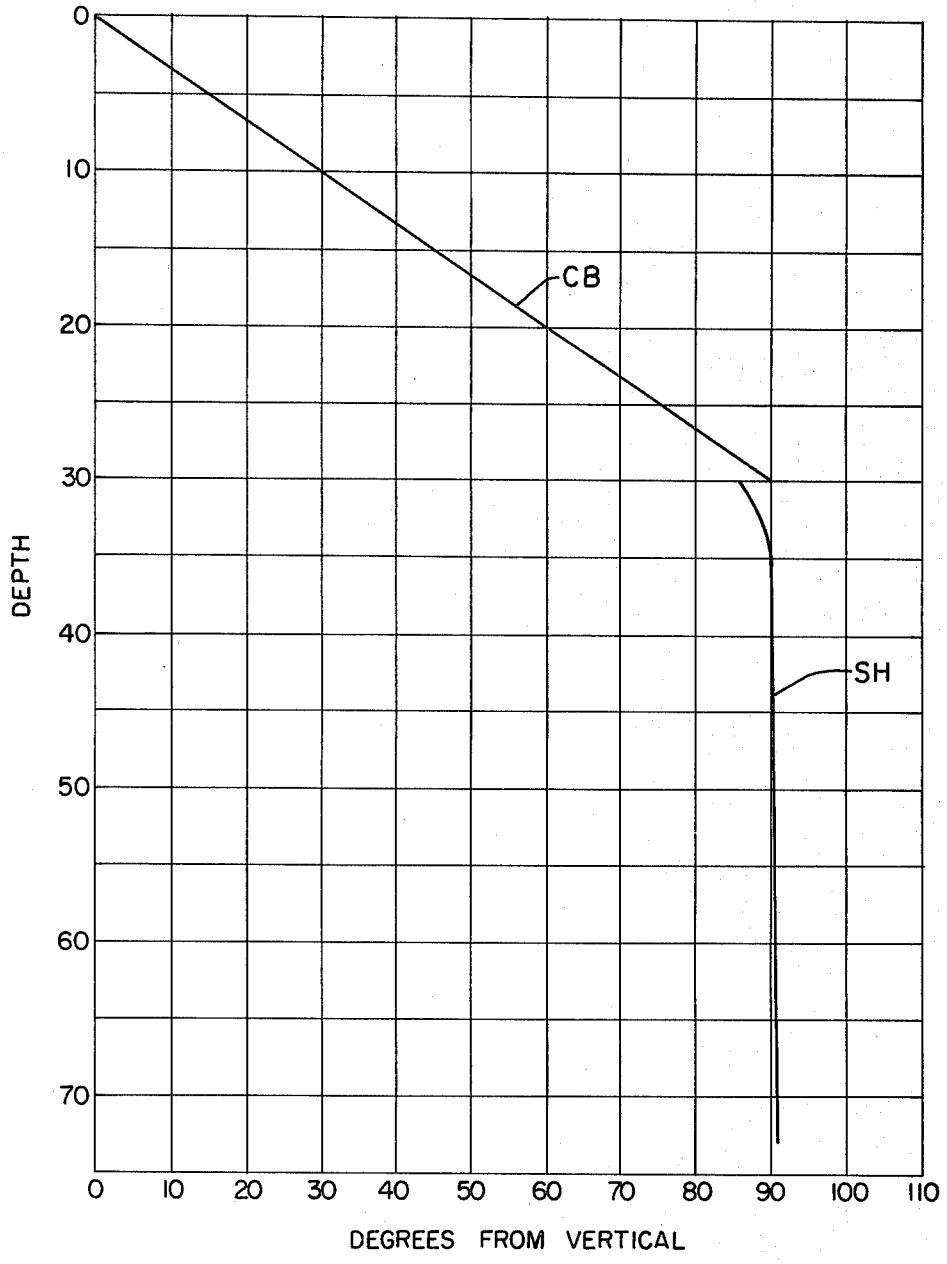
FIG. 7 is a graph of drift angle (angle from vertical) measurements illustrating the take-off of a straight bore from a curved section utilizing the stabilizer assemblies of the present invention.

FIG. 7 is a plot of the drift angle versus drilled depth based on measurements periodically taken along the curved section and illustrates the rapidity with which the preferred form of stabilizer assembly will establish an essentially straight hole designated SH once departing from the curved bore CB already drilled. In this relation, it will be evident that the stabilizer assemblies as described may be utilized in drilling the entire well bore from the surface where it is desired to maintain a straight bore and avoid unintentional curved sections as drilling progresses.

DETAILED DESCRIPTION OF ANOTHER MODIFIED FORM OF INVENTION

Figure 8:
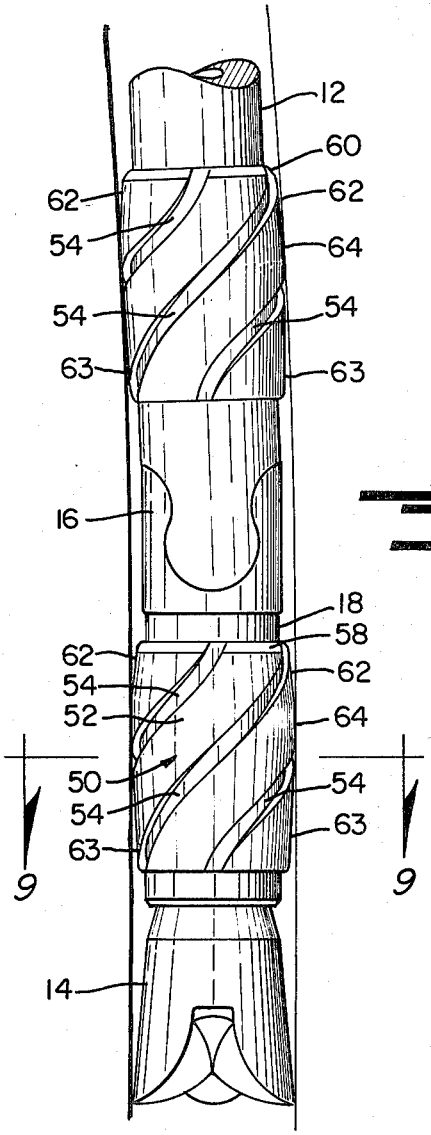
FIG. 8 is a sectional view of a modified form of stabilizer assembly in accordance with the present invention.
Figure 9:
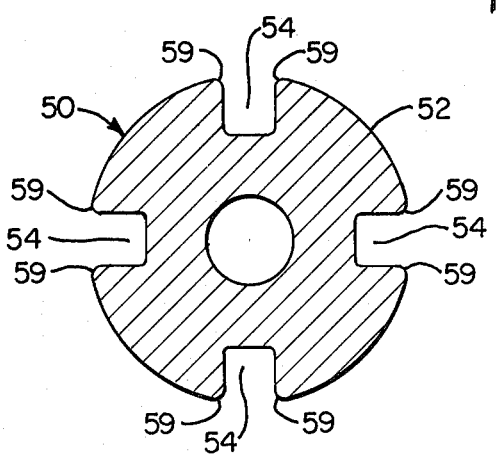
FIG. 9 is a cross-sectional view taken about lines 9—9 of FIG. 8.
Figure 10:
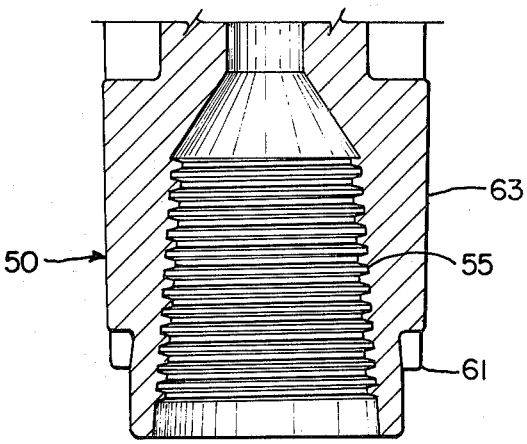
FIG. 10 is a cross-sectional view along the longitudinal axis of the modified form of stabilizer assembly shown in FIG. 8.

In the modified form of invention illustrated in FIGS. 8 to 10, the stabilization formula $RC=L^2/2a$ is applicable to the arrangement shown wherein a drill string 12 has a drill bit 14 threadedly connected to a modified form of stabilizer 50 mounted at the lower end of drill collar 18, the latter extending downwardly from a joint 16. As in the preferred and first modified forms, there may be one or more joints 16 wherein the joint 16 as illustrated in FIG. 8 would then comprise the lowermost in a series of joints 16. The modified form of stabilizer 50 comprises a plurality of helically extending blades 52 separated by helical grooves 54 which are of relatively narrow width compared to the width of the blades 52. A threaded counterbore 55 is tapered for connection to the upper complementary end of the drill bit 14, and upper end 58 forms a unitary extension of the drill collar 18 for conjoint rotation with the drill string 12 and collar 18. For most effective stabilization and specifically to avoid cutting into the sidewall of the bore, the blades 52 are of generally rectangular cross-sectional configuration being relatively blunt or rounded along side edges 59 as well as having rounded edges 60 and 61 at upper and lower ends, respectively, of the stabilizer 50.

It should be noted that while the stabilizer 50 is illustrated at the lower end of the drill collar 18, it may be formed in a manner corresponding to that illustrated in the modified form of FIG. 6 wherein the blades are formed on the external surface of the drill collar at a predetermined spacing or distance L above the drill bit, L being the initial point of contact on the external surface of the stabilizer with the wall of the hole. In the stabilizer 50 as illustrated in FIGS. 8 to 10, the initial point or area of contact between the stabilizer 50 and the wall of the hole is established by tapering the external blades 52 both in a forward and rearward direction, as designated at 62 and 63, respectively, away from the intermediate section 64. Thus, the stabilizer will have its maximum diameter at the intermediate section 64, this section being located relatively near the trailing end and away from the leading end of the stabilizer so as to maximize the distance between the leading end of the drill bit and the initial contact point or section on the stabilizer. This is especially useful in the form of invention shown in FIGS. 8 to 10 in which the stabilizer is positioned directly behind the drill bit. Further, as in the case of the preferred and first modified forms of invention, one or more additional stabilizers 50 may be interposed between the series of joints in addition to the stabilizer 50 positioned below the lowermost joint.

Utilization of the lowermost stabilizer 50 on the drill collar minimizes any tendency of sidewall cutting, particularly in drainhole applications. For this reason, it is important that the stabilizer not be hard faced and have blunt side edges 59 and ends 60 as described, since it has been found that it is better to wear the stabilizer and replace it than to permit it to cut into the sidewall of the hole. The clearance between the stabilizer blades and hole formed by the bit should be maintained at a minimum. For instance, the blades should establish a diametric clearance as low as 0.005". Moreover, the blades 52 should have adequate length with grooves 54 of minimum width to maximize the surface area and afford sufficient blade surface to work out of any sticking or jamming in the hole. However, a definite limitation in length is imposed on the stabilizer in that it must pass through the curved bore to reach the operating position; otherwise, if the stabilizer were longer there would be a tendency to ream the ends until the additional length is nullified, and place the tools in danger of becoming stuck in the hole.

When the stabilizer 50 is to be passed through a sharper curved section of a hole, its maximum diameter or gauge at the intermediate section 64 should approximate or be just less than that of the bit; and, again most desirably intermediate section 64 is located toward the trailing end of the stabilizer so as to be of a maximum distance away from the bit. The tapered sections 62 and 63 also serve to avoid any tendency for the stabilizer blades 52 to be worn or effectively reamed by the surrounding rock formation in the hole on the trip into the well through the formation and particularly will avoid any danger that the rock formation may place a greater taper on the trailing ends of the blades 52 than actually necessary to freely traverse the curve and which could otherwise result in placing the maximum diameter of the stabilizer closer to the bit and result in reduced stabilizer effeciency in accordance with the stabilization formula $RC=L^2/2a$.

It is therefore to be understood that various modifications and changes may be made in the specific sequence of steps as well as the construction and arrangement of parts in the preferred and modified forms of invention as described without departing from the spirit and scope of the present invention as defined by the appended claims.

I claim:

1. In apparatus adaptable for drilling a straight bore as a continuation of a curved bore wherein a rotatable drill string includes a drill bit secured to a drill collar and is rotatable with said drill string, the improvement comprising:

at least one articulated joint mounted for rotation with and between said drill string and said drill collar, and a stabilizer member above at least the lowermost of said articulated joint and fixed for rotation with said drill string, each stabilizer member having an outside diameter substantially corresponding to that of said straight bore to be drilled and the length of said apparatus between said drill bit and the lowermost of said articulated joint being of the maximum allowable length which will permit said apparatus to pass through said curved bore.

2. In apparatus according to claim 1, there being a pair of articulated joints each having a rigid, generally cylindrical section extending between said joints, and said stabilizer member being disposed in outer concentric relation to said generally cylindrical section between said joints.

3. In apparatus according to claim 2, each said stabilizer member defined by a series of circumferentially spaced, spirally extending blades disposed about the external surface of said cylindrical section between said joints, said member having an outer diameter corresponding to that of the bore to be drilled.

4. In apparatus according to claim 1, said stabilizer member defined by a generally ring-like member having a diameter corresponding to that of the bore to be drilled.

5. In apparatus according to claim 1, there being an alternating succession of articulated joints and stabilizer members above said drill bit, first and second stabilizer members above said drill bit having a diameter corresponding to that of said bore to be drilled, and the remainder of said stabilizer members each having a diameter less than that of said first and second stabilizer members but greater than that of said joints.

6. In apparatus according to claim 1, said lowermost of said joints having a generally cylindrical section connected to said drill collar, and each next successive joint having a generally cylindrical section provided with an intermediate portion having longitudinally extending flat surfaces joined by rounded corners, each stabilizer member defined by a ring affixed in outer surrounding relation to said flat surface portions whereby to define clearance spaces between said ring and said flat surface portions for the flow of fluid therethrough.

7. In apparatus according to claim 6, each said ring being affixed to said corners.

8. In apparatus according to claim 1, including a lower stabilizer member mounted on said drill collar for rotation with said drill string.

9. In apparatus according to claim 8, said lower stabilizer member having a plurality of blades provided with rounded edges, said blades separated by grooves of narrow width in relation to that of said blades.

10. In apparatus according to claim 9, said blades having external surfaces tapering both forwardly and rearwardly from an intermediate surface portion of maximum diameter.

11. In apparatus for drilling a straight bore as a continuation of a curved bore having a rotatable drill string and a drill bit secured to a drill collar and rotatable with said drill string, the improvement comprising:

a plurality of universal joints mounted for rotation with and between said drill string and said drill collar, and a stabilizer member interposed between each pair of said joints and fixed for rotation with said drilling string, said stabilizer members each having an outside diameter substantially corresponding to that of said straight bore to be drilled and the length of said apparatus between said drill bit and the first of said universal joints being of the maximum allowable length which will permit said apparatus to pass through said curved bore.

12. In apparatus according to claim 11, each said stabilizer member defined by a generally cylindrical section corresponding in diameter to said universal joints and a series of circumferentially spaced spirally extending blades disposed about the external surface of said cylindrical section, said blades having a diameter corresponding to that of said bore to be drilled.

13. In apparatus according to claim 11, said stabilizer member defined by a generally cylindrical member having a diameter corresponding to that of said universal joints and an outer concentric tubular member affixed to said inner cylindrical member, said outer tubular member having an external diameter corresponding to that of said bore to be drilled.

14. In apparatus according to claim 11, said first and second stabilizer members above said drill bit having a diameter corresponding to that of said hole to be drilled and each next successive stabilizer being of progressively reduced diameter in relation to that of said first and second stabilizer members.

15. The method of modifying the direction of a well bore from a curved section into a straight section comprising the steps of:

pivotally connecting a stabilizer member to a drill collar at the end of a drill bit for rotation therewith, the gauge of the stabilizer substantially corresponding to the gauge of the drill bit and being spaced from the drill bit the maximum distance a rigid body of reduced diameter, held closely to the mid-point of the hole at each end, can have and still not contact the wall of the curved hole section;

pivotally connecting additional stabilizer members to the first stabilizer member whereby to absorb change angle forces introduced by reactive formation moments;

lowering the drill bit and assembled stabilizer through the curved hole section until the drill bit is positioned at the lower terminal end of the curved hole section with its cutting edge on the bottom of the bore; and followed by rotating the drill bit and assembled stabilizer sections to continue drilling of the well bore in the corrected direction.

16. The method according to claim 15, further characterized by interposing articulated joints between said stabilizer members and between said lowermost stabilizer member in said drill collar.

17. The method according to claim 16, characterized by positioning said stabilizer members intermediately between said joints.

18. In apparatus adaptable for drilling a straight bore as a continuation of a curved bore wherein a rotatable drill string includes a drill bit secured to a drill collar and is rotatable with said drill string, the improvement comprising:

an alternating succession of articulated joints and stabilizer members above said drill bit, said stabilizer members fixed for rotation with said drill string including first and second stabilizer members above said drill bit having a diameter corresponding to that of said bore to be drilled, and the remainder of said stabilizer members each having a diameter less than that of said first and second stabilizer members but greater than that of said articulated joints.

19. In apparatus adaptable for drilling a straight bore as a continuation of a curved bore wherein a rotatable drill string includes a drill bit secured to a drill collar and is rotatable with said drill string, the improvement comprising:

at least one articulated joint mounted for rotation with and between said drill string and said drill collar, and a stabilizer member above at least the lowermost of said joint and fixed for rotation with said drill string, each stabilizer member having an outside diameter substantially corresponding to that of said straight bore to be drilled and the length of said apparatus between said drill bit and the lowermost of said articulated joints being of the maximum allowable length which will permit said apparatus to pass through said curved bore; and said lowermost of said joints having a generally cylindrical section connected to said drill collar, and each next successive joint having a generally cylindrical section provided with an intermediate portion having longitudinally extending flat surfaces joined by rounded corners, each stabilizer member defined by a ring affixed in outer surrounding relation to said flat surface portions whereby to define clearance spaces between said ring and said flat surface portions for the flow of fluid therethrough.

20. In apparatus adaptable for drilling a straight bore as a continuation of a curved bore wherein a rotatable drill string includes a drill bit secured to a drill collar and is rotatable with said drill string, the improvement comprising:

at least one articulated joint mounted for rotation with and between said drill string and said drill collar, a stabilizer member affixed for rotation with said drill collar and interposed between said articulated joint and said drill bit, said stabilizer having an external surface tapering both forwardly and rearwardly from an intermediate section of maximum diameter, said intermediate surface portion located relatively mear the trailing end of said stabilizer and away from said leading end.

21. In apparatus according to claim 20, said stabilizer having a plurality of blades provided with rounded edges, said blades separated by grooves of narrow width in relation to that of said blades with the external surfaces of said blades tapering both forwardly and rearwardly from said intermediate surface portion.

* * * * *

UNITED STATES PATENT AND TRADEMARK OFFICE

CERTIFICATE OF CORRECTION

PATENT NO. : 4,456,080

DATED : June 26, 1984

INVENTOR(S) : Don R. Holbert

It is certified that error appears in the above-identified patent and that said Letters Patent is hereby corrected as shown below:

Column 8, line 17, "effeciency" should read -- efficiency --.

Column 12, line 1 (Claim 20) "mear" should read -- near --.

Signed and Sealed this

*Twelfth* Day of *February 1985*

[SEAL]

*Attest:*

DONALD J. QUIGG

*Attesting Officer* *Acting Commissioner of Patents and Trademarks*